US005826392A

United States Patent [19]

Bischel et al.

[11] Patent Number: 5,826,392

[45] Date of Patent: Oct. 27, 1998

[54] TRANSITION MEMBER FOR VARYING CEILING LEVELS

[75] Inventors: Wesley T. K. Bischel, Lancaster; Richard D. Stackenwalt, Dallastown, both of Pa.

[73] Assignee: Armstrong World Industries, Inc., Lancaster, Pa.

[21] Appl. No.: 874,290

[22] Filed: Jun. 13, 1997

[51] Int. Cl.[6] ..... E06B 3/70

[52] U.S. Cl. ..... 52/459; 52/716.2; 52/277

[58] Field of Search ..... 52/276, 277, 275, 52/282.1, 506.08, 716.2, 717.03, 204.705, 204.7, 35, 459

[56] References Cited

U.S. PATENT DOCUMENTS 3,047,112 7/1962 Tvoriak et al. ..... 52/277 X 3,387,419 6/1968 Kamberg et al. ..... 52/716.2 X 3,634,892 1/1972 Rains ..... 52/716.2

*Primary Examiner*—Creighton Smith

[57] ABSTRACT

The apparatus is a transition member to cover the gap between ceilings at different levels which are also offset horizontally. A vertical section is supported at the edge of the lower ceiling and an attached angular section rises from the lower edge at a slope to reach and contact the upper ceiling. The general shape approximates a trough with one vertical and one sloped side. The lower edge of the vertical section and the upper edge of the angular section can include flanges and attached coupling channels which interlock with drywall adapters to facilitate attachment to drywall ceilings.

13 Claims, 3 Drawing Sheets

TRANSITION MEMBER FOR VARYING CEILING LEVELS

BACKGROUND OF THE INVENTION

This invention deals generally with ceilings and more specifically with a transition member interconnecting two different levels of a ceiling.

Ceilings with different levels are a common architectural feature because they are used for both decorative and functional purposes. In large rooms with wide expanses of ceiling, islands of lower levels relieve the monotony of a continuous unbroken view of the entire ceiling. For lighting units which are hung below a ceiling, a second lower level of ceiling can be used to essentially integrate the lights into the ceiling material, and for items such as lights or draperies, "pockets" of higher levels of ceiling are used to mount them on the structural ceiling when a suspended ceiling is used.

For each situation with more than one level of ceiling, there is a need to use a transition member to connect the different levels. Without such transition members the space between the levels is exposed and visible, and such a configuration both detracts from the appearance of the room and is difficult to clean when it collects dust.

While there exist systems which act as transitions between different levels of ceiling, the existing systems have shortcomings. For instance, U.S. Pat. No. 5,165,209 by Bischel et al provides a curved transition, but is usable only with a specific ceiling structure. Furthermore the "AXIOM" Perimeter Trim system sold by Armstrong World Industries, furnishes a versatile transition trim arrangement usable with various ceiling materials, but can provide only a straight vertical transition.

SUMMARY OF THE INVENTION

The present invention provides a transition member between different levels of ceiling which functions with different types of ceiling material such as drywall or acoustical ceilings, but which is not limited to a straight vertical trim plate.

This is accomplished by forming a transition member which has one section similar to the prior art vertical channel trim so that the transition member can be installed on prior art ceiling support structures. However, the transition member of the invention also includes an integral angled section which extends upward from near the bottom edge of the vertical section at an angle to the vertical to span any gap caused by the different ceiling levels being offset. The entire transition member is thereby preferably supported from the lower ceiling section, but extends to and into contact with the higher ceiling section.

The general configuration of the transition member is essentially that of a trough with one vertical side and the other side sloped up from near the bottom of the vertical side. However, the sloped side can have any cross sectional shape, including concave, convex, or several complex curves.

The invention also includes a part which can be used as a connector when one or both ceiling levels are constructed with drywall. This drywall adapter interlocks with coupling channels at the upper and lower ends of the transition member and is feathered to a thin edge to allow the creation of a taped edge bead for the drywall. The structure of the drywall adapter and its position when interlocked with the transition member provides another advantage of the invention over the prior art systems. The transition member of the invention and the drywall adapter can be installed together after drywall is installed on both the upper and lower ceiling sections. Prior art systems required that the drywall on the lower ceiling be installed only after the transition member was installed. This meant that when drywall was used on both the upper and lower ceilings, the installation of the two drywall ceiling levels had to be interrupted for installation of the transition section.

A further advantage of the transition member of the invention is that when drywall adapters are used, the adapters can be installed upon the transition member at floor level and the entire assembly raised to the ceiling levels as one piece.

The invention therefore provides a versatile transition member for ceilings with different levels that are offset from each other, and the transition member can be used for both acoustic ceilings and drywall ceilings or any combination of the two, while providing virtually any profile for the cross section of the transition member.

DETAILED DESCRIPTION OF THE INVENTION

Figure 1:
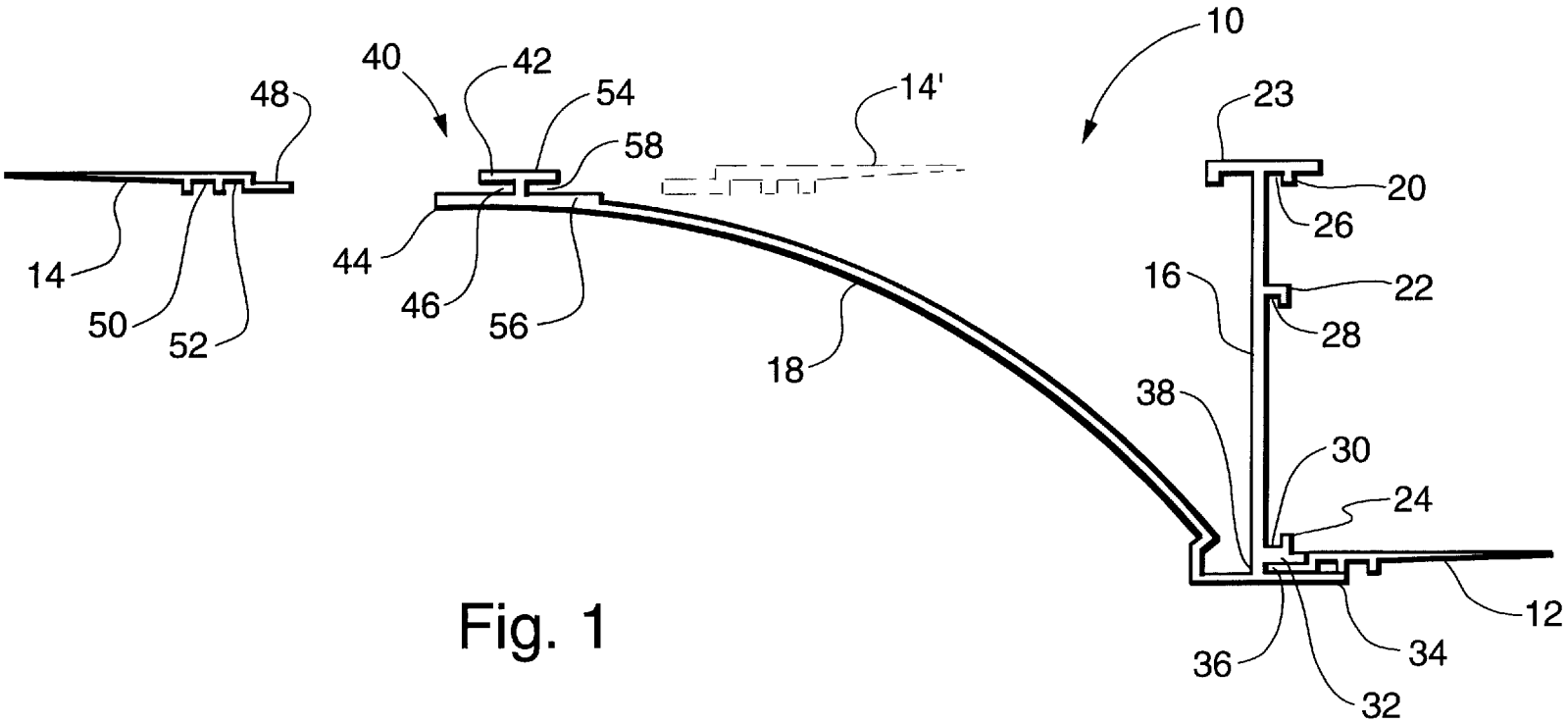
FIG. 1 is an end view of the preferred embodiment of the transition member of the invention.

FIG. 1 is an end view of the preferred embodiment of transition member 10 of the invention with lower drywall adapter 12 installed into transition member 10 and upper drywall adapter 14 separated from transition member 10, as it would be when it is about to be installed. Drywall adapters 12 and 14 are identical.

The view of FIG. 1 is also the cross section of transition member 10 throughout its entire length. Transition member 10 can be made as long as is necessary to connect two levels of ceiling, and lengths of transition member 10 can be butted together at their ends to supply greater lengths when needed.

Figure 2:
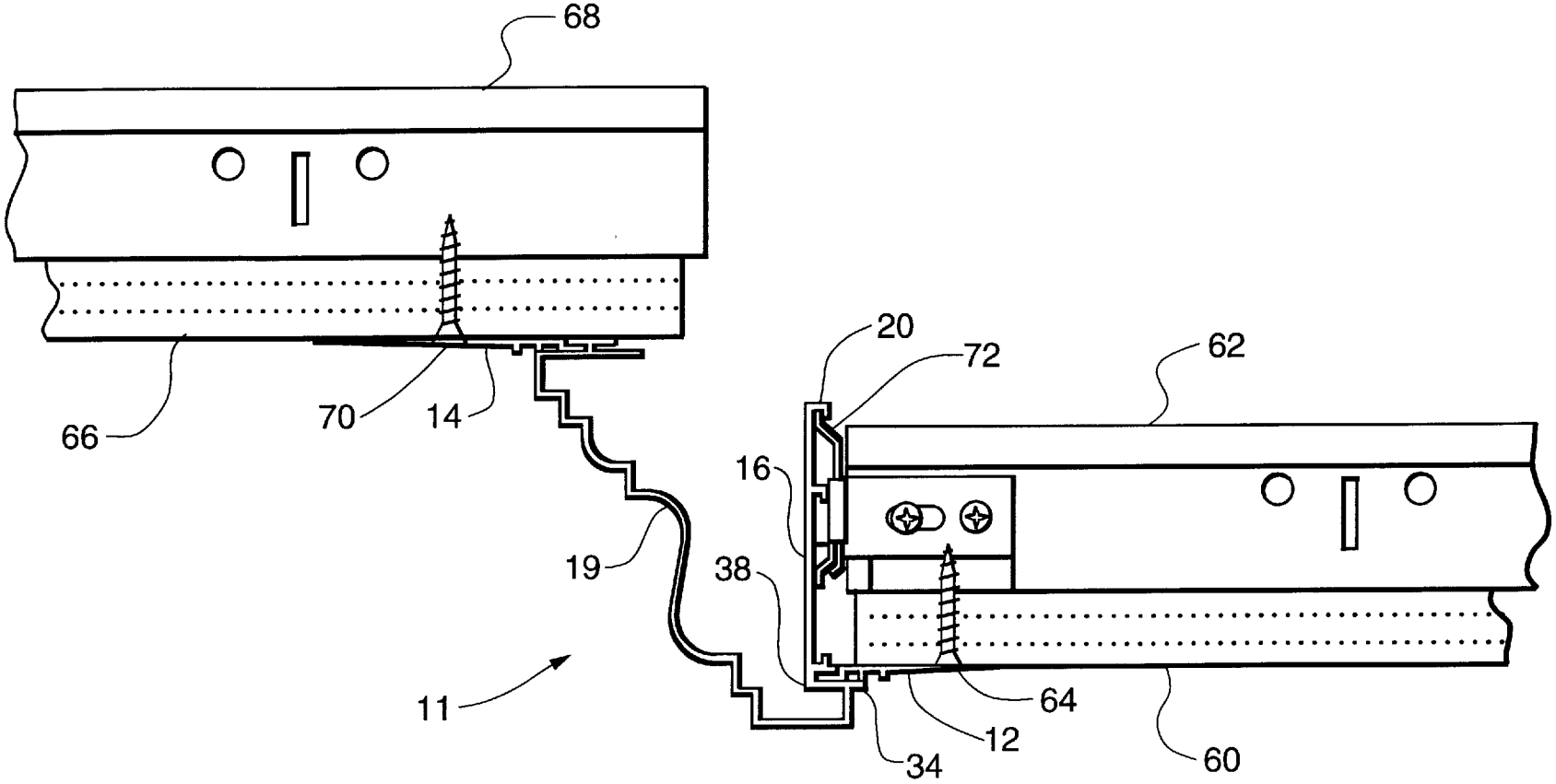
FIG. 2 is an end view of an alternate decorative configuration of the invention installed upon a ceiling with two drywall surfaces.
Figure 3:
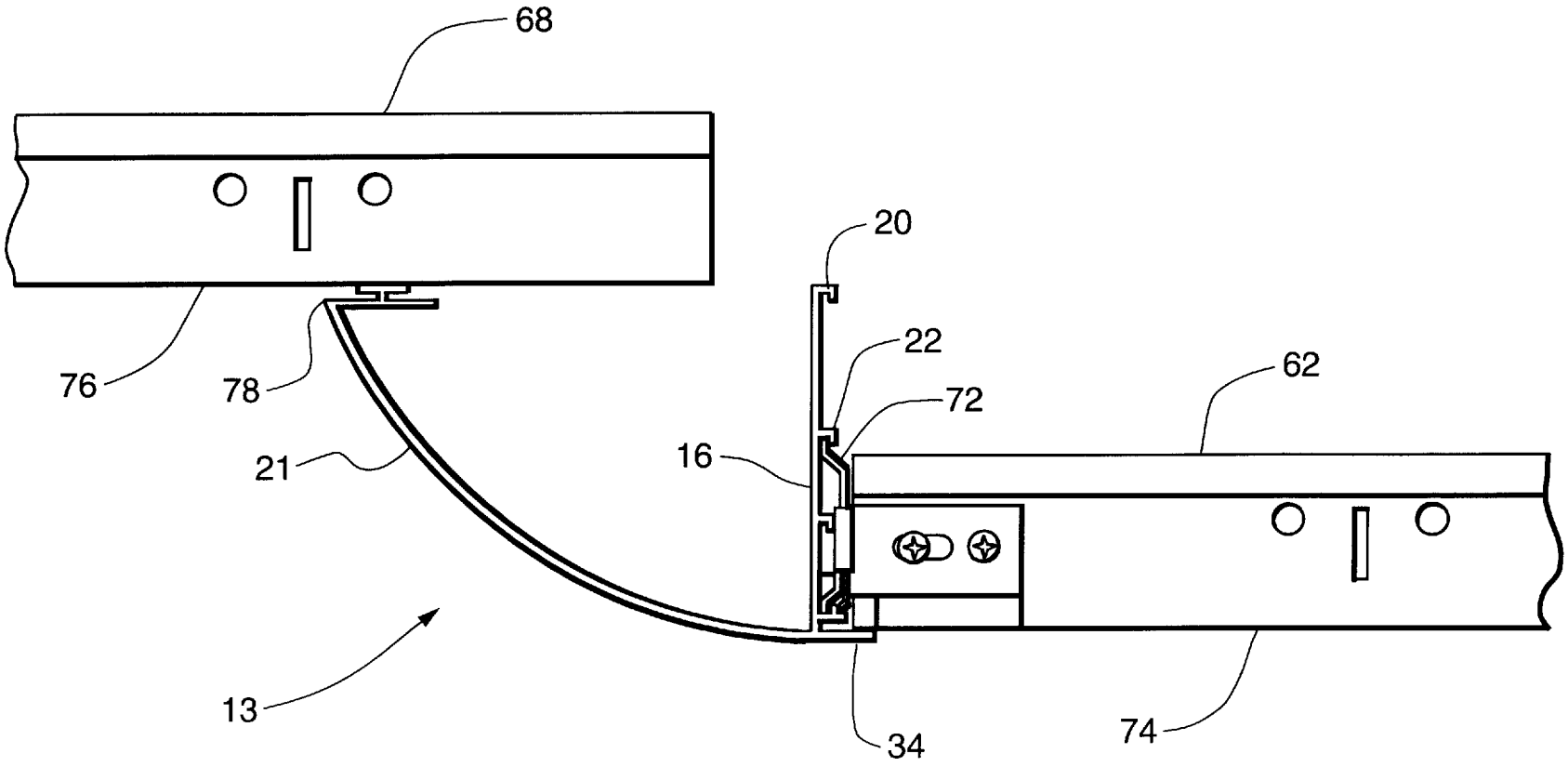
FIG. 3 is an end view of a second alternate decorative configuration of the invention installed upon an acoustic ceiling support structure.

Transition member 10 includes vertical section 16 and angular section 18. Vertical section 16 includes ribs 20, 22, and 24 which form channels 26, 28, and 30 by which transition member 10 can be attached to ceiling grid tee member 62 as shown in FIG. 2 and FIG. 3. The operation of ceiling trim connector 72 (FIGS. 2 and 3) to attach vertical section 16 to ceiling grid tee 62 is more fully explained in U.S. Pat. No. 5,572,844 which is incorporated herein and made a part of the disclosure of this specification.

In FIG. 1, vertical section 16 is shown including attachment flange 23 at the top of vertical section 16 and integrated with rib 20. Attachment flange 23 provides a surface for additional attachment to the upper ceiling and thereby adds significant strength to transition member 10 once it is installed.

Vertical section 16 can also include rib 32 and flange 34 forming channel 36, none of which are disclosed in U.S. Pat. No. 5,572,844. Coupling channel 36 is used in the present invention to provide a receptacle for lower drywall adapter 12 when drywall is used for the lower ceiling. However, as can be seen in FIG. 2 and FIG. 3, flange 34 also functions as an edge trim regardless of the material used for the lower ceiling.

Returning to FIG. 1, angular section 18 of transition member 10 is attached near lower edge 38 of vertical section 16. Angular section 18 extends upward and outward from its attachment point to vertical section 16 at the appropriate angle to span the vertical and horizontal separations between lower ceiling 60 and upper ceiling 66 (FIG. 2). However, the distance of the horizontal separation is not at all critical since upper end 40 of angular section 18 can terminate inward from the edge of the upper ceiling.

Upper end 40 of angular section 18 can include rib 42 and flange 44 which are constructed to form coupling channel 46 to interlock with coupling edge 48 of drywall adapter 14. Drywall adapters 12 and 14 are identical and include coupling edges 48 to be inserted into coupling channels 36 and 46. Slot 50 can be formed in drywall adapters 12 and 14 so that the drywall adapter will permit expansion and contraction of the ceiling, helping to prevent ceiling cracks. Rib 54 and flange 56 form coupling channel 58 located on the backside of channel 46. Channel 58 therefore allows upper drywall adapter 14 to be used as an attachment device on an acoustical ceiling. In such an application reversed drywall adapter 14', shown in dashed lines, is attached to the ceiling and coupling channel 58 of angular section 18 is coupled to drywall adapter 14' thereby hiding it under angular section 18. However, in some situations, particularly with acoustical upper ceilings, there is no need for any connection between angular section 18 and the upper ceiling. As shown in FIG. 3, with vertical section 16 of the transition member held fast to a structural member of the ceiling, the curvature of the angular section provides enough spring action to hold the end of angular section 21 against the upper ceiling. In such a situation it would be possible to omit not only ribs 42 and 54, but also flange 44. However, when the ribs are used, for additional holding strength, a piece of drywall trim such as 14' of FIG. 1 can be inserted and fixed to the upper ceiling.

FIG. 2 is an end view of an alternate decorative configuration of the invention installed upon a ceiling with two drywall surfaces. The only difference between transition member 10 of FIG. 1 and transition member 11 of FIG. 2 is that angular section 19 in FIG. 2 is shaped with several steps and curves for an enhanced decorative effect as opposed to angular section 18 of FIG. 1 which is a simple concave surface.

FIG. 2 shows how the invention is used with drywall ceiling surfaces. Lower drywall ceiling 60 is attached to conventional ceiling grid tee member 62 by conventional means such as drywall screw 64, and drywall screw 64 can also be used to install lower drywall adapter 12 of the invention on lower drywall ceiling 60. Upper drywall adapter 14 and upper drywall ceiling 66 are installed on upper ceiling grid tee 68 by the same technique using drywall screw 70. Transition member 11, or any other configuration of the invention is held in place between lower ceiling 60 and upper ceiling 66 by ceiling trim connector 72 which is attached to vertical section 16 and to ceiling grid tee member 62 as is more fully explained in U.S. Pat. No. 5,572,844 which is incorporated herein and made a part of the disclosure of this specification.

FIG. 3 is an end view of an alternate decorative configuration of the invention installed upon a ceiling with two acoustical surfaces. The only difference between transition member 10 of FIG. 1 and transition member 13 of FIG. 3 is that angular section 21 in FIG. 3 is shaped with a convex curve for a different decorative effect than angular section 18 of FIG. 1 which is a concave surface.

FIG. 3 shows how the invention is used with acoustical ceiling surfaces. Lower ceiling 74 is installed upon conventional ceiling grid tee member 62 by conventional means. Upper drywall ceiling 76 is installed on upper ceiling grid tee 68 by the same means. Transition member 13 is, however, held in a slightly different position for an acoustical ceiling than transition member 11 of FIG. 2 is positioned for a drywall ceiling. In order to accommodate to the added thickness of a drywall ceiling, trim connector 72 is held by higher rib 20 of vertical section 16 when a drywall lower ceiling is used, but is held by lower rib 22 when an acoustical lower ceiling is used. As previously noted FIG. 3 depicts an installation in which there is no need for any connection between angular section 21 and the upper ceiling. With vertical section 16 of transition member 13 held securely to ceiling grid tee member 62, the curvature of angular section 21 provides enough spring action to hold edge 78 of angular section 13 against upper ceiling 76. It should be appreciated that in an installation such as that shown in FIG. 3 it is not necessary to include coupling channels 26, 36, 46, and 58 (FIG. 1) on the transition member, since drywall adapters are not used. However, since such omissions require the stocking of a larger inventory of parts, it is more economical to include the coupling channels in all parts manufactured, and simply not use them when they are not needed.

The transition members are preferably made of extruded aluminum because, by using extruded aluminum, the members can be made with greater detail and have decorative variations and designs as shown in FIG. 2. Although steel can also be used, steel can not be formed in such detail and with such intricate decorative variations as can extruded aluminum.

The present invention thereby provides a transition member between different levels of ceilings which not only spans the vertical separation but also bridges any horizontal spacing between the different ceiling levels. Moreover, the invention functions with various types of ceiling materials, and can provide a variety of decorative configurations. Furthermore, several transition members can be joined together to form greater lengths. In such circumstances, a drywall trim member such as 14' of FIG. 1 can be inserted into coupling channels 58 of two abutting transition members to hold the transition members in alignment.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, any transition member can be used with different surface materials on the ceiling levels at its opposite ends, and, as previously mentioned, coupling channels and flanges at the edges may be omitted.

What is claimed as new and for which Letters Patent of the United States are desired to be secured is:

1. A transition member between different levels of a ceiling comprising:

a horizontal upper ceiling level;

a horizontal lower ceiling level located below the upper ceiling level;

a vertical section with an upper edge and a lower edge parallel to each other and at least a first rib and a second rib protruding from one side of the vertical section, each rib shaped to form a channel along the vertical section, with the two channels parallel to, separated from, and facing each other, and with the first rib located adjacent to the lower edge of the vertical section with the lower edge of the vertical section located adjacent to the lower ceiling level; and an angular section with an upper and a lower edge, with the lower edge of the angular section attached to the vertical section and protruding upward from where it is attached and away from the vertical section with the upper edge of the angular section located adjacent to the upper ceiling level.

2. A transition member between different levels of a ceiling comprising:

a vertical section with an upper edge and a lower edge parallel to each other and at least a first rib and a second rib protruding from one side of the vertical section, each rib shaped to form a channel along the vertical section, with the two channels parallel to, separated from, and facing each other, and with the first rib located adjacent to the lower edge of the vertical section; and an angular section with an upper and a lower edge, with the lower edge of the angular section attached to the vertical section and protruding upward from where it is attached and away from the vertical section; and further including a first flange attached to the lower edge of the vertical section, spaced away from the first rib, and forming a coupling channel with the first rib, with the coupling channel parallel to the first and second channels.

3. The transition member of claim 2 further including a second flange attached to the upper edge of the angular section.

4. The transition member of claim 2 further including a second flange attached to the upper edge of the angular section and a third rib attached to the second flange in a manner to form a coupling channel with an open side away from the vertical section.

5. The transition member of claim 2 further including a second flange attached to the upper edge of the angular section, a third rib attached to the second flange in a manner to form a coupling channel with an open side away from the vertical section, and a fourth rib attached to the second flange in a manner to form a coupling channel with an open side toward the vertical section.

6. The transition member of claim 2 further including at least one drywall adapter with a coupling edge which interlocks with a coupling channel, with the drywall adapter including a feathered edge at the edge remote from the coupling edge.

7. The transition member of claim 6 wherein the drywall adapter includes slots formed parallel to its edges to permit the drywall adapter to flex to relieve the strain of expansion and contraction of a ceiling to which the transition member is attached.

8. The transition member of claim 2 wherein the angular section has a convex shape.

9. The transition member of claim 2 wherein the angular section has a concave shape.

10. The transition member of claim 2 wherein the angular section has a shape including complex curves.

11. The transition member of claim 2 further including a fifth rib protruding from the same side of the vertical section as the first and second rib, the fifth rib located more remote from the first rib than the from the second rib and shaped to form a channel along the vertical section, with the channel oriented in the same direction as the channel formed by the second rib.

12. The transition member of claim 2 wherein the transition member is constructed of extruded aluminum.

13. The transition member of claim 2 further including an attachment flange at the top of the vertical section, the attachment flange including a horizontal surface for attachment to a ceiling.

* * * * *